United States Patent [19]

Haderer et al.

[11] 4,231,151

[45] Nov. 4, 1980

[54] METHOD AND APPARATUS FOR MANUFACTURING A FILAMENT SERVED BONDABLE CONDUCTOR

[75] Inventors: Norman G. Haderer; J. Harold Troy, both of Bristol, Va.

[73] Assignee: Westinghouse Electric Corp., Pittsburgh, Pa.

[21] Appl. No.: 948,138

[22] Filed: Oct. 3, 1978

[51] Int. Cl.[3] ..... H01F 41/06

[52] U.S. Cl. ..... 29/605; 156/53; 427/118; 427/425; 427/432; 427/433

[58] Field of Search ..... 29/605, 596, 598; 156/53, 56, 48, 51, 52, 425, 428–433; 427/118–120

[56] References Cited

U.S. PATENT DOCUMENTS 2,504,845 4/1950 Keyes ..... 156/56

2,935,631 5/1960 Jones ..... 29/605 X 3,027,287 3/1962 Hammer et al. ..... 156/56

*Primary Examiner*—Carl E. Hall

*Attorney, Agent, or Firm*—R. D. Fuerle

[57] ABSTRACT

A filament served bondable conductor is described. A metal wire is wrapped with an insulating yarn then suspended between two supports. After passing over the first support, the wire is immersed in a varnish, excess varnish is removed, and the varnish is cured in an oven before the wire passes over the second support. The wire is again suspended between two more supports. After passing over the third support the wire is immersed in an enamel, excess enamel is removed, and the enamel is cured to a non-tacky B-stage in the same oven. The wire can then be wound on a take-up reel until needed. The wire can be formed into coils and the coils heated to fuse and completely cure the enamel.

11 Claims, 1 Drawing Figure

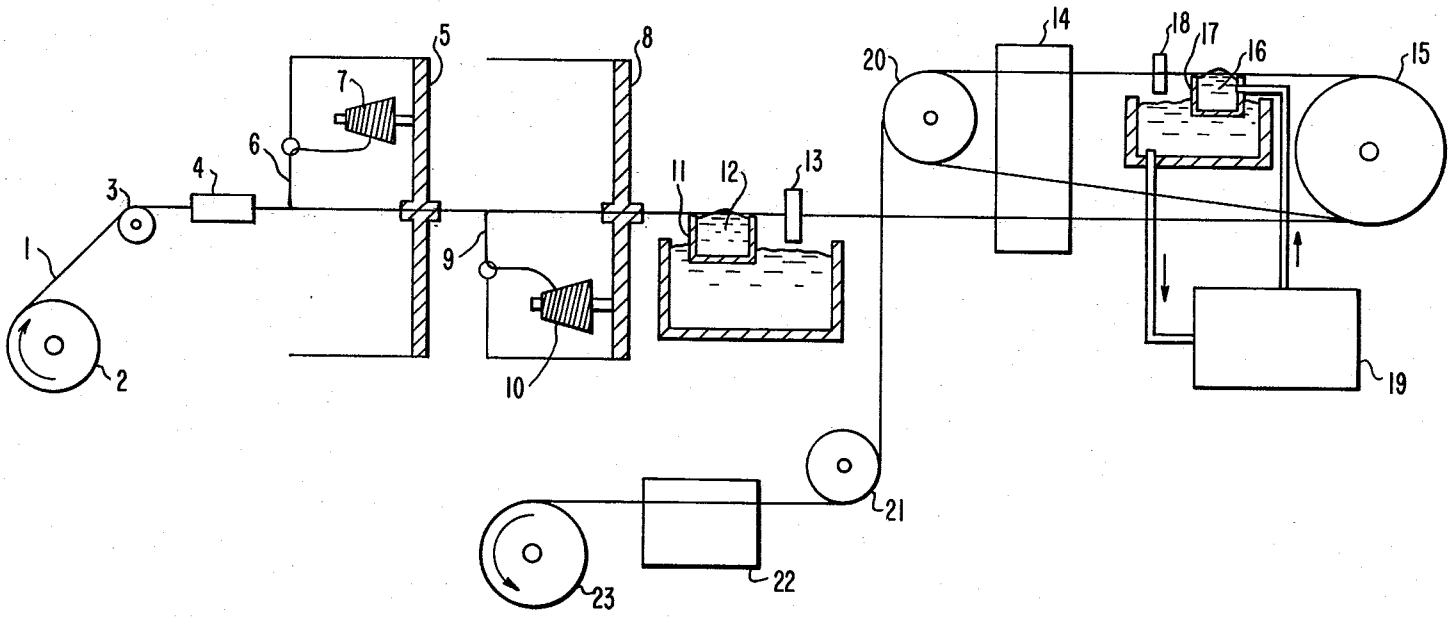
1
2
3
4
5
6
7
8
9
10
11
12
13
14
15
16
17
18
19
20
21
22
23

METHOD AND APPARATUS FOR MANUFACTURING A FILAMENT SERVED BONDABLE CONDUCTOR

BACKGROUND OF THE INVENTION

In the manufacture of formed armature coils, wire wound field coils, solenoid coils, and other types of coils where a mechanically rigid self-supporting winding is desired it has been a normal processing procedure to apply a bushing or bakelizing resin between each of the layers of insulated conductor as it is being wound into the coil. The winding is then clamped or braced and is heated to cure the resin system. After curing, the clamps or braces are carefully removed and all excess cured resin residue and flashing are removed by grinding or other techniques.

This procedure is messy due to resin which drips off the coils. The wasted resin and the time required to brush on enamel also makes the procedure expensive. The final results vary due to the exactness and care of resin application. Also, workers can become sensitive to liquid resins which must be applied in open areas as this procedure requires.

SUMMARY OF THE INVENTION

We have found that a bondable conductor can be made which has yarn insulation impregnated with a cured varnish and a B-staged enamel overcoat. In the process of this invention energy is conserved and costs reduced by curing both the varnish and the enamel in the same oven. A smooth, continuous coating of both the varnish and the enamel is achieved by suspending the wire between supports and not contacting the wire until the freshly applied resin has solidified in the oven. A uniform application is achieved by wiping excess resin off the wire, especially by using a metering die.

The bondable conductor produced by the process and apparatus of this invention can be stored on reels until needed, then wound into coils which fuse into a solid mass when heated.

PRIOR ART

U.S. Pat. No. 2,935,631 discloses a process and apparatus for making an insulated bondable conductor.

DESCRIPTION OF THE INVENTION

The accompanying drawing is a diagrammatic side view of a certain presently preferred embodiment of this invention.

In the drawing, wire 1 leaves pay-off reel 2 and passes over sheave 3 into wire cleaner 4 where the wire is cleaned of dirt and grease and is dried. At wrapping station 5 yarn 6 from spindle 7 is wrapped over the wire, and at wrapping station 8 yarn 9 from spindle 10 is wrapped over the wire in the opposite direction. The wire then passes through overflow bath 11 where varnish 12 is applied to the insulated wire. A wipe 13 removes excess resin. The suspended wire passes through oven 14 which cures and solidifies the resin before it passes over sheave 15. The wire is coated with an enamel 16 from overflow bath 17. A wipe 18 is used to remove excess resin. The resin that overflows is recirculated to a resin reservoir 19 where the dirt is filtered out and the resin can cool and make-up solvent added, which prevents it from solidifying in the overflow bath. The wire passes through oven 14, which hardens the resin, then over sheave 20. Additional varnish on enamel coats can be applied to the wire by passing it between sheaves 15 and 20, applying resin each time. After the last pass the wire is taken over sheave 21, through water cooling bath 22, then onto take-up reel 23.

The number of layers of yarn applied to the wire may be as many as desired, though two is the usual number and they are preferably applied in opposite direction. The yarn may be of glass, Dacron (polyethylene terephthalate), cotton, glass-Dacron mixture, or other suitable material. The preferred material is glass or a glass-Dacron mixture. If Dacron is used it is preferable to pass the wire through the oven once before the varnish is applied in order to melt and solidify the Dacron.

The varnish fills the interstices in the yarn. Various types of varnish may be used such as silicone, polyester, epoxy, and amide-imide. Epoxies are preferred as they have the best physical properties on wire. The varnish is cured in the oven typically at temperatures of about 500° to about 850° F. depending upon the particular varnish used. A suitable oven is about 16 feet long with two heating zones for heating the wire on both the top and bottom pass. Small wire needs less time in the oven and can therefore usually be run at about 40 feet per minute through the oven, while large wire requires more time in the oven and is usually run at about 20 feet per minute. Several layers of varnish may be applied if desired.

The enamel top coat must be a B-stageable resin which can adhere to the varnish. The enamel may be a thermoset or a thermoplastic, but a thermoset phenolic resin is prferred as it has been found to have excellent properties. Epoxies, polyesters, and other resins may also be used. Generally, the varnish and the enamel are selected so that the same oven temperature can be used for both. About 1½ to about 3 mils of enamel in total are usually applied to each side of the wire. The amount applied with each pass will be much less, of course, and two to six or more passes may be needed to obtain the desired thickness. The enamel should be B-staged after each pass through the oven so that it does not stick to the sheaves.

When the varnish and enamel are applied to the wire the excess resin must be wiped off if a uniform coating is to be produced. While cloth wipes, rubber gaskets, and the like can be used, wiping is most advantageously accomplished by means of a metering die because it applies a coating which has a more precisely controlled thickness than do other types of wipes. A metering die typically consists of two shaped jaws under a predetermined spring compression between which the wire passes. The wire used in this invention is commonly rectangular copper or aluminum about 0.032 by about 0.072 inches up to about 0.182 by about 0.525 inches.

The two separate varnish and enamel systems give added versatility. By selecting enamel/varnish combinations the insulated wire can be constructed with dual systems to meet requirements that could not otherwise be met with a single enamel or varnish coat. With the proper selection of varnish/enamel combinations, insulations, and therefore systems where the insulated wire is used, can be upgraded thermally, mechanically, and chemically. For example, a glass served wire treated with a polyester varnish can be upgraded thermally with the addition of a silicone enamel, or amide-imide enamel thermo-set or thermoplastic enamel overcoat.

The following examples further illustrate this invention.

EXAMPLE

Two layers of Dacron-glass yarn were applied in opposite directions (total thickness 9 to 13 mils) to samples of rectangular copper wire 0.129 inches by 0.204 inches. The wire was then passed through an oven heated to 800° C. at 35 feet per minute to fuse the Dacron in the yarn. Then three applications were made of an epoxy varnish sold by Celanese Corporation under the trademark "Devran," described as an epichlorohydrin-bisphenol type epoxy resin with 15 to 25% catalyst, 65% solids, and an Sp. Gr. at 25° C. of 1.030. The varnish was cured in the oven at 430° C. after each application.

To some of the wire samples, designated "TCG," (for "Thermally Cementable Glass") a high temperature thermoset phenolic enamel solid by P. D. George Co. as "6385" was applied before the last pass through the oven, which B-staged the enamel, while the remaining samples were passed through the oven without the application of an enamel. Four pieces of these remaining samples were brushed with various commercial enamels. (The "6385" resin was described as having a Sp. Gr. at 25° C. of 0.962 to 1.010, a viscosity Brookfield Spindle 3 at RPM 12 of 2000 to 5000 cps, a solids contents of 23 to 25%, a flash point of 39° C., a make-up solvent of 4:1 aromatic 100 or xylene to cresylic acid, and a reducing solvent of 3:1 Aromatic 100 or xylene to cresylic acid.) Two of the four pieces were then placed end-to-end and the other two pieces were clamped over the joints overlapping 2 inches of each of the end-to-end pieces. The enamels were then cured as recommended by their manufacturers. Two pieces of the TCG samples were also placed end-to-end and another two pieces were clamped over the joints as before (with no additional enamel being applied). The clamped pieces were heated at 200° C. for 3 minutes.

The clamps were removed and the force in pounds per square inch necessary to pull the two end-to-end pieces apart at 25° C. and at 135° C. was determined for the TCG bond and for the three commercial enamels tested. (This lap shear test is the same as ASTM 2295 and 2557 except that it was modified for glass served/-treated conductor). The following table gives the results (as an average value after testing 5 samples of each).

| Enamel | 25° C. | 135° C. |
|---|---|---|
| "TCG" | 706 | 671 |
| Epoxy resin sold by Sterling Corp. as "U-3000" | 743 | 650 |
| Epoxy pre-catalyzed bonding resin sold by Westinghouse Electric Corporation as "53841 MT" | 688 | 679 |
| Propylene adipate fumarate polyester resin sold by Westinghouse Electric Corporation as "53836EF" | 726 | 638 |

The above table shows that the method of this invention (TCG) produced lap shear strengths comparable to samples prepared in the conventional manner.

We claim:

1. A method of making a fused coil comprising:

(1) wrapping a metal wire with an insulating yarn;

(2) suspending said wire between a first support and a second support, there being no support in between said first support and said second support;

(3) immersing said wire in a heat curable varnish after said wire passes over said first support;

(4) wiping excess varnish off said wire;

(5) heating said wire in an oven to cure said varnish before said wire passes over said second support;

(6) suspending said wire between a third support and a fourth support, there being no support in between said third and fourth supports;

(7) immersing said wire in a heat curable enamel after said wire passes over said third support;

(8) wiping excess enamel off said wire;

(9) heating said wire in said oven sufficiently to cure said enamel to a nontacky B-stage before said wire passes over said fourth support;

(10) winding said wire to form said coil; and

(11) heating said coil to cure and fuse said enamel.

2. A method according to claim 1 wherein said excess enamel is wiped off with a metering die.

3. A method according to claim 1 wherein two layers of yarn are wrapped around said wire in opposite directions.

4. A method according to claim 1 wherein said wire is immersed in an overflowing bath of said enamel and enamel which overflows is pumped to a reservoir of enamel before it is recirculated to said bath.

5. A method according to claim 1 wherein said wire is cooled after passing over said fourth sheave and is then wound on a take-up reel before being formed into a coil.

6. A method according to claim 1 wherein said enamel is applied to said wire two to six times.

7. Apparatus for forming a fusable enamel coating on an insulated wire comprising:

(1) means for wrapping said wire with an insulating yarn;

(2) a first support and a second support for suspending said wire, there being no supports in between said first support and said second support;

(3) means for applying a heat curable varnish to said wire after it has passed over said first support;

(4) means for wiping excess varnish off said wire;

(5) a third support and a fourth support for suspending said wire, there being no supports in between said third support and said fourth suport;

(6) means for applying a heat curable enamel to said wire after it has passed over said third support;

(7) means for wiping excess enamel off said wire; and (8) an oven for heating said wire to cure said varnish before said wire passes over said second support, and to cure said enamel to a non-tacky B-stage before said wire passes over said fourth support.

8. Apparatus according to claim 7 wherein said means for wiping excess enamel off said wire is a metering die.

9. Apparatus according to claim 7 wherein said means for wrapping said wire with insulating yarn applies two layers of yarn to said wire in opposite directions.

10. Apparatus according to claim 7 wherein said means for applying a heat curable enamel to said wire is an overflow bath, and includes a reservoir and means for transporting the overflow to said reservoir and recirculating said enamel from said reservoir to said overflow bath.

11. Apparatus according to claim 7 including means for cooling said wire after it passes over said fourth support, and a take-up reel onto which said cooled wire is wound.

* * * * *